US006272307B1

(12) United States Patent
Ishizuka et al.

(10) Patent No.: US 6,272,307 B1
(45) Date of Patent: Aug. 7, 2001

(54) RELEASING AGENT COATING DEVICE INCLUDING RELEASING AGENT HEATER

(75) Inventors: Jiro Ishizuka, Numazu; Takashi Fujita; Keisuke Inoue, both of Shizuoka-ken; Shozo Shimada, Nobeoka, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/627,444

(22) Filed: Jul. 27, 2000

(30) Foreign Application Priority Data

Jul. 30, 1999 (JP) ..... 11-217140

(51) Int. Cl.[7] ..... G03G 15/20
(52) U.S. Cl. ..... 399/325; 219/216
(58) Field of Search ..... 399/324–326; 219/216; 118/60, 101; 432/60

(56) References Cited

U.S. PATENT DOCUMENTS

| | | | | |
|---|---|---|---|---|
| 3,883,291 | | 5/1975 | Cloutier et al. | 432/60 |
| 4,087,676 | | 5/1978 | Fukase | 219/216 |
| 4,132,882 | * | 1/1979 | Endo et al. | 219/216 |
| 4,563,073 | | 1/1986 | Reynolds . | |
| 6,091,924 | * | 7/2000 | Bhattacharya | 399/325 |

FOREIGN PATENT DOCUMENTS

| | | |
|---|---|---|
| 0 316 010 | 5/1989 | (EP) . |
| 58-200266 | 11/1983 | (JP) . |

OTHER PUBLICATIONS

European Search Report.

* cited by examiner

*Primary Examiner*—William J. Royer
(74) *Attorney, Agent, or Firm*—Fitzpatrick, Cella, Harper & Scinto

(57) ABSTRACT

The present invention provides a fixing apparatus which has a fixing member for fixing an unfixed image to a recording material, a releasing agent coating device for coating releasing agent on the fixing member, the releasing agent coating device having a containing portion for containing the releasing agent, and a releasing agent heating device for heating the releasing agent, wherein the releasing agent heating device have a heating body, and a heat conductive member contacted with the heating body or disposed near the heating body, and the heating body is disposed outside of the containing portion, and the heat conductive member is disposed within the containing portion to be contacted with the releasing agent.

11 Claims, 7 Drawing Sheets

RELEASING AGENT COATING DEVICE INCLUDING RELEASING AGENT HEATER

BACKGROUND OF THE INVENTION

1. Field of the Invention

The present invention relates to a fixing apparatus applied to an image forming apparatus such as a copying machine, a printer and the like, and more particularly, it relates to an apparatus for coating a releasing agent to a fixing member.

2. Related Background Art

FIG. 9 shows a fixing apparatus as a background art of the present invention. As shown in FIG. 9, a fixing apparatus 50 comprises a fixing roller 51 as a rotatable fixing rotary member, a pressure roller 52 as a pressurizing rotary member rotated while abutting against the fixing roller 51, a releasing agent coating device 53 as releasing agent coating means, and cleaning devices 54, 55. Incidentally, heaters 56, 57 such as halogen lamps are disposed within the fixing roller 51 and the pressure roller 52, respectively. Further, thermistors 58, 59 are contacted with the fixing roller 51 and the pressure roller 52 so that surface temperatures of the fixing roller 51 and the pressure roller 52 are adjusted by controlling voltages to the heaters 56, 57 by means of a temperature adjusting circuit.

The releasing agent coating device 53 comprises a releasing agent containing portion 53*a* for containing releasing agent such as silicone oil, pick-up rollers 53*b*, 53*c* for picking up the releasing agent from the releasing agent containing portion 53*a*, a coating roller 53*d* for coating the picked-up releasing agent to the fixing roller 51, and regulating blade 53*e* formed from an elastic material such as fluororubber and adapted to regulate an amount of the releasing agent on the coating roller to a given amount. Particularly in order to realize uniform oil coating on the fixing roller 51, the releasing agent coating device 53 is disposed at a downstream side of the thermistor 58 in a rotational direction of the fixing roller 51.

When a recording paper P is conveyed, the fixing roller 51 and the pressure roller 52 are rotated and the silicone oil is coated on the surface of the fixing roller 51 as the releasing agent. While the recording paper P is being passed between the fixing roller 51 and the pressure roller 52, the recording paper is pressurized and heated from both sides with substantially uniform pressure and temperature, with the result that an unfixed toner image is fixed to the recording paper P, thereby forming a permanent image. Thereafter, the recording paper P to which the toner image was fixed is separated from the pressure roller 52 by a lower separation claw 68 and is discharged out of the apparatus.

Generally, in the thermal fixing apparatus for a copying machine, after a power supply is turned ON, the copying machine is waiting for a predetermined time period until the fixing roller reaches a predetermined temperature, and, after the predetermined temperature is reached, a copy permitting condition is obtained. However, a fixing ability is differentiated between a condition (referred to as "first run in the morning condition" hereinafter) immediately after the copy permitting condition is reached and a condition (referred to as "left condition" hereinafter) after a predetermined time period is elapsed from the copy permitting condition as a stand-by condition. The reason is that not only the surface temperature of the fixing roller but also the temperature of the entire fixing apparatus and particularly the temperature of the releasing agent to be coated on the surface of the fixing roller are differentiated between the first run in the morning condition and the left condition. Namely, in the left condition, since the heat from the fixing roller is transferred to the releasing agent through the coating roller and the pick-up rollers, the temperature of the releasing agent is increased. In this condition, even when the releasing agent is coated on the fixing roller, the reduction of the temperature of the fixing roller is small, and, since the releasing agent between the fixing roller and toner has high temperature, the fixing ability is not improved.

On the other hand, in the first run in the morning condition, the temperature of the releasing agent is low, and, when the low temperature releasing agent is coated on the fixing roller, the temperature of the fixing roller is decreased rapidly, and, since there is low temperature releasing agent between the fixing roller and the toner, the fixing ability is worsened. This will be more noticeable under a low temperature environment.

In order to solve such problems, an arrangement for heating the releasing agent from outside of the releasing agent containing portion has been proposed.

However, the heat from outside of the releasing agent containing portion is insufficient to heat the releasing agent quickly and adequately.

Japanese Patent Application Laid-Open No. 58-200266 discloses a technique in which a heater is disposed within oil in order to maintain fluidity of the oil and to aid an operation of a bimetal.

However, if the heater is disposed within the oil, since conductive portions may be short-circuited, a more safety technique is desired.

SUMMARY OF THE INVENTION

An object of the present invention is to provide a fixing apparatus which can heat releasing agent quickly and sufficiently while improving electrical safety.

Another object of the present invention is to provide a fixing apparatus comprising a fixing member for fixing an unfixed image to a recording material, releasing agent coating means for coating releasing agent on the fixing member, and releasing agent heating means for heating the releasing agent, wherein the releasing agent coating means have a containing portion for containing the releasing agent, and the releasing agent heating means have a heating body, and a heat conductive member contacted with the heating body or disposed in the vicinity of the heating body, and the heating body is disposed outside of the containing portion, and the heat conductive member is disposed within the containing portion to be contacted with the releasing agent.

The other objects and features of the present invention will be apparent from the following detailed explanation of invention referring to the accompanying drawings.

DETAILED DESCRIPTION OF THE PREFERRED EMBODIMENTS

The present invention will now be explained in connection with embodiments thereof with reference to the accompanying drawings.

As an example of an image forming apparatus to which a fixing apparatus according to an embodiment of the present invention is applied, a four-drum type laser beam printer having a plurality of light scanning means will be described with reference to FIGS. 7 and 8.

Figure 7:
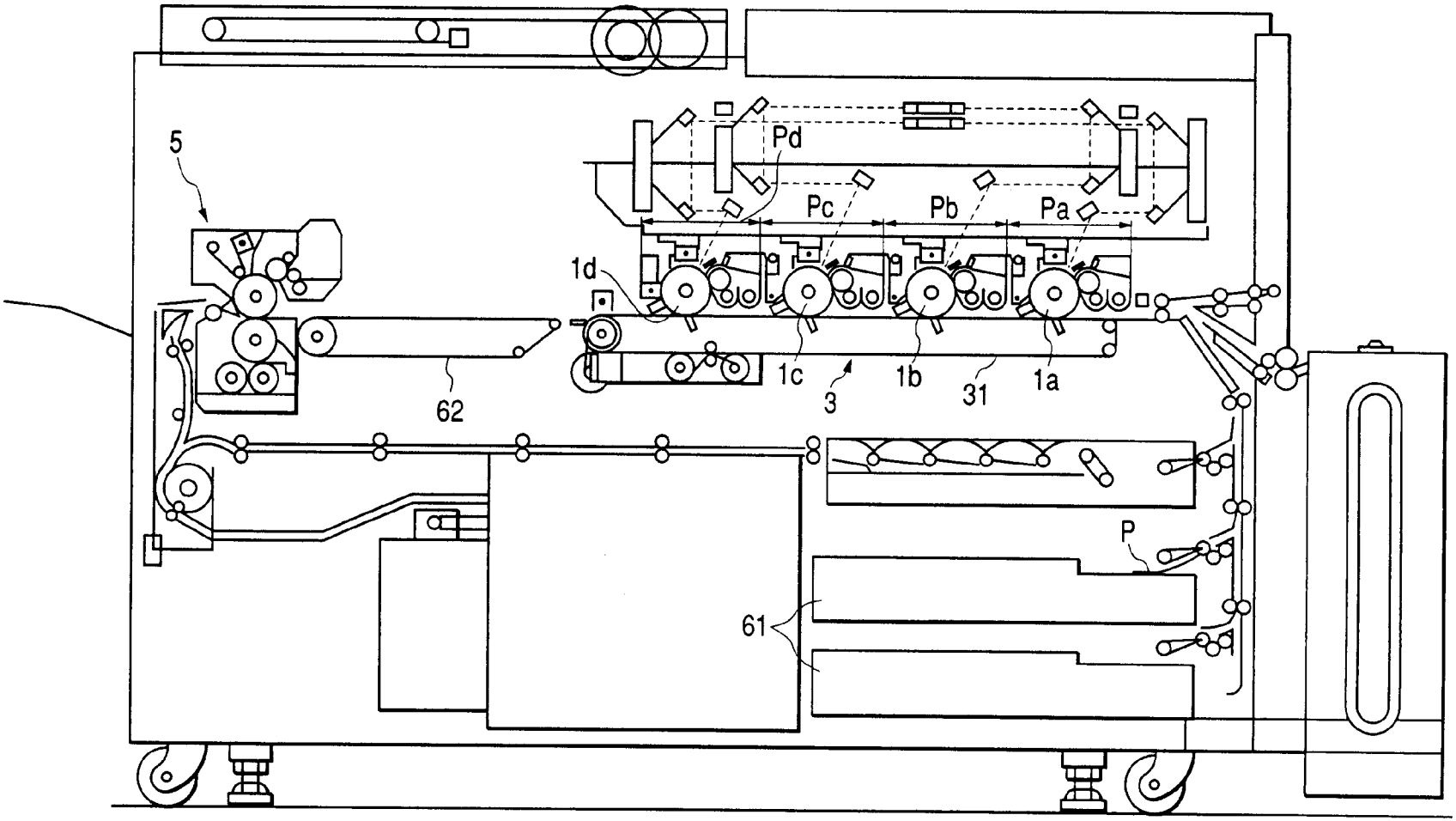
FIG. 7 is a view showing an image forming apparatus to which the fixing apparatus according to an embodiment of the present invention is applied.
Figure 8:
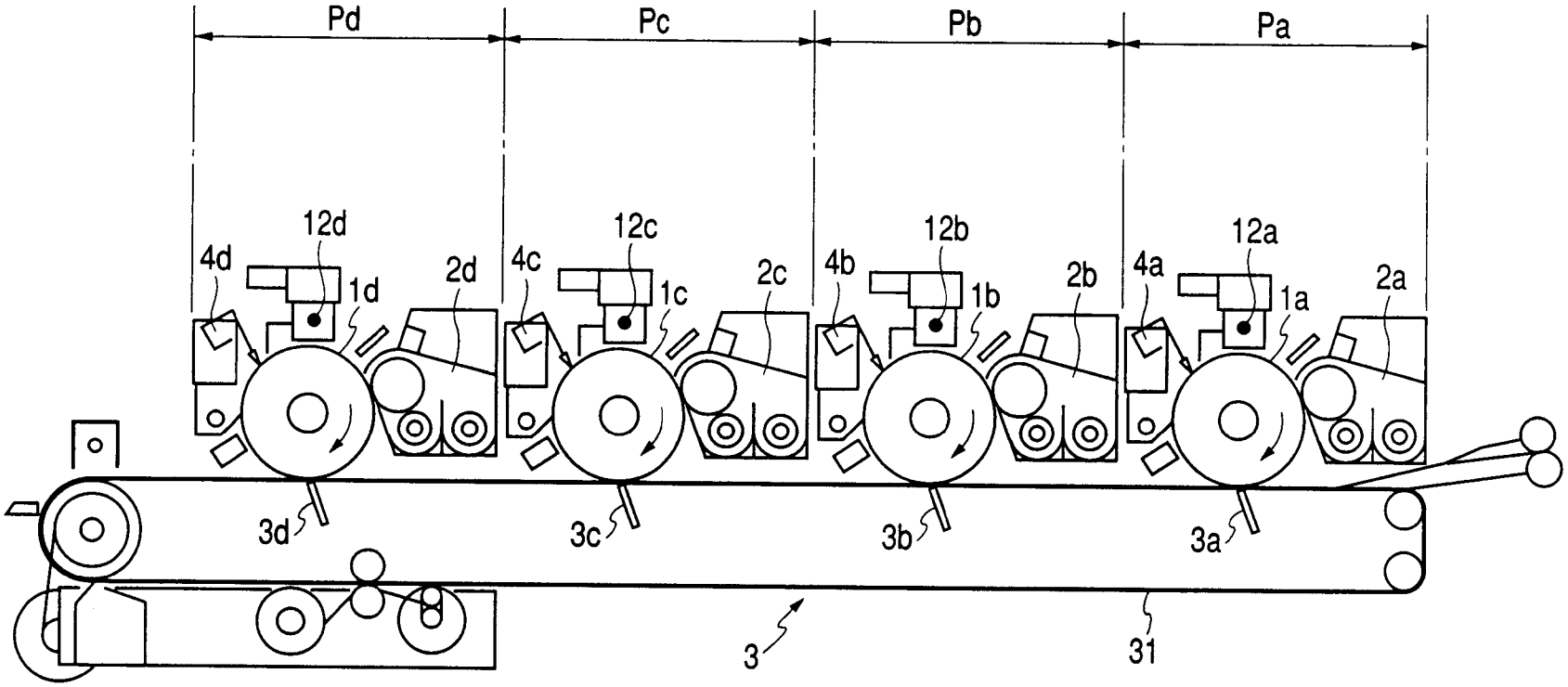
FIG. 8 is a view showing an image forming portion of the image forming apparatus.
Figure 9:
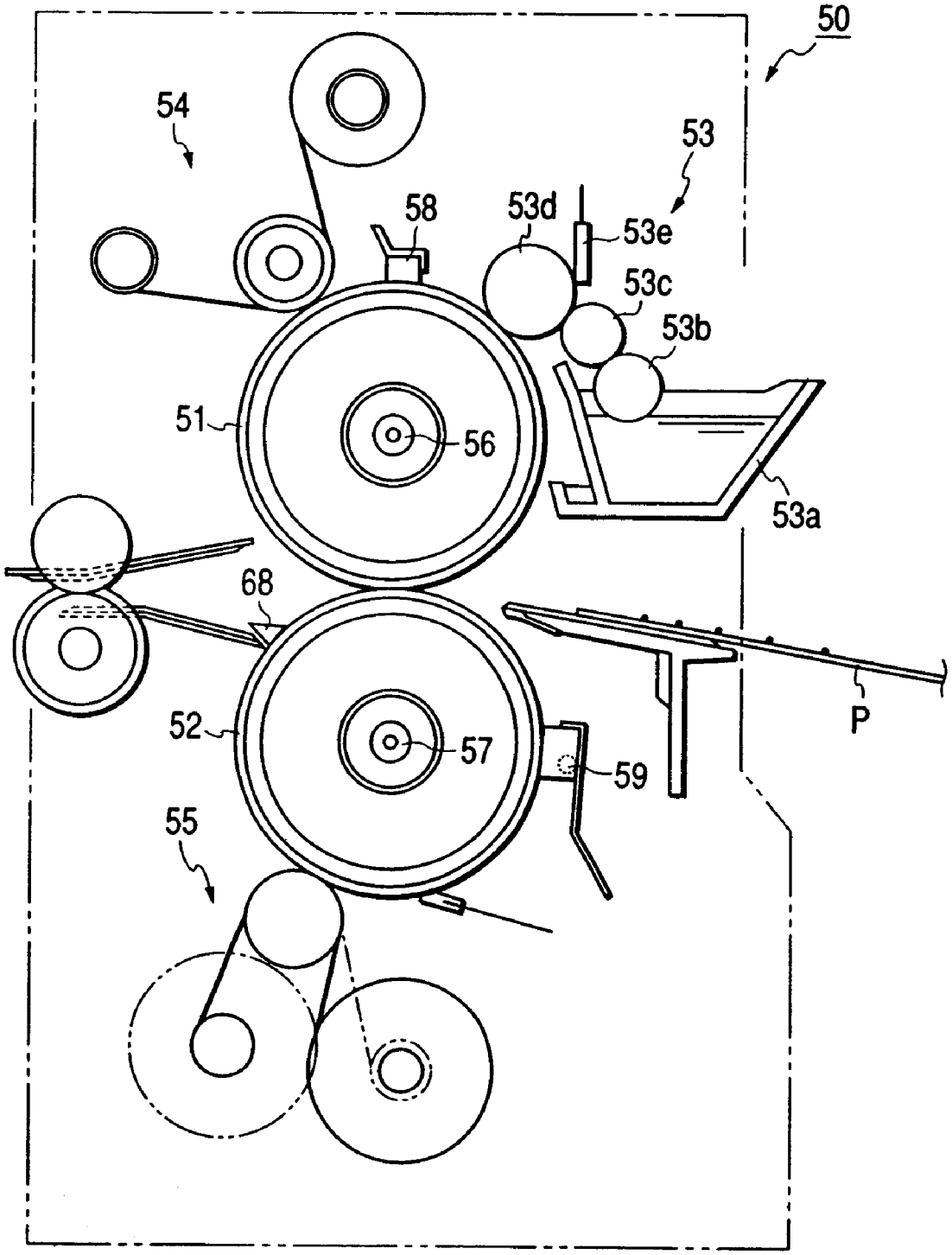
FIG. 9 PRIOR ART
FIG. 9 is a view showing a fixing apparatus which is a background art of -the present invention.

FIG. 7 is a sectional view of the image forming apparatus (laser beam printer), and FIG. 8 is a sectional view of an image forming portion of the image forming apparatus. As shown in FIG. 7, four image forming stations Pa, Pb, Pc, Pd as image forming means are disposed side by side within a main body of the image forming apparatus.

The image forming stations Pa, Pb, Pc, Pd serve to form magenta, cyan, yellow and black color images, respectively, and, as shown in FIG. 8, these stations have photosensitive drums 1*a*, 1*b*, 1*c*, 1*d* rotated in directions shown by the arrows, respectively.

Further, around the photosensitive drums 1*a*, 1*b*, 1*c*, 1*d*, there are disposed chargers 12*a*, 12*b*, 12*c*, 12*d*, developing apparatuses 2*a*, 2*b*, 2*c*, 2*d* and cleaners 4*a*, 4*b*, 4*c*, 4*d*, respectively, which are located in order along rotational directions of the photosensitive drums 1*a*, 1*b*, 1*c*, 1*d*. A transfer portion 3 is disposed below the photosensitive drums 1*a*, 1*b*, 1*c*, 1*d*. Incidentally, the transfer portion 3 includes a transfer belt 31 as recording material conveying means common to the image forming stations Pa to Pd, and transfer chargers 3*a*, 3*b*, 3*c*, 3*d*.

In the printer having the above-mentioned construction, a recording paper P fed from a sheet feeding cassette 61 as recording material feeding means shown in FIG. 7 is supported on the transfer belt 31 and is conveyed to the image forming stations Pa to Pd, where various color toner images formed on the photosensitive drums 1*a* to 1*d* are successively transferred onto the recording paper. After the transferring, the recording paper P is separated from the transfer belt 31 and then is conveyed to a fixing apparatus by a conveying belt 62 as recording material guiding means.

Figure 1:
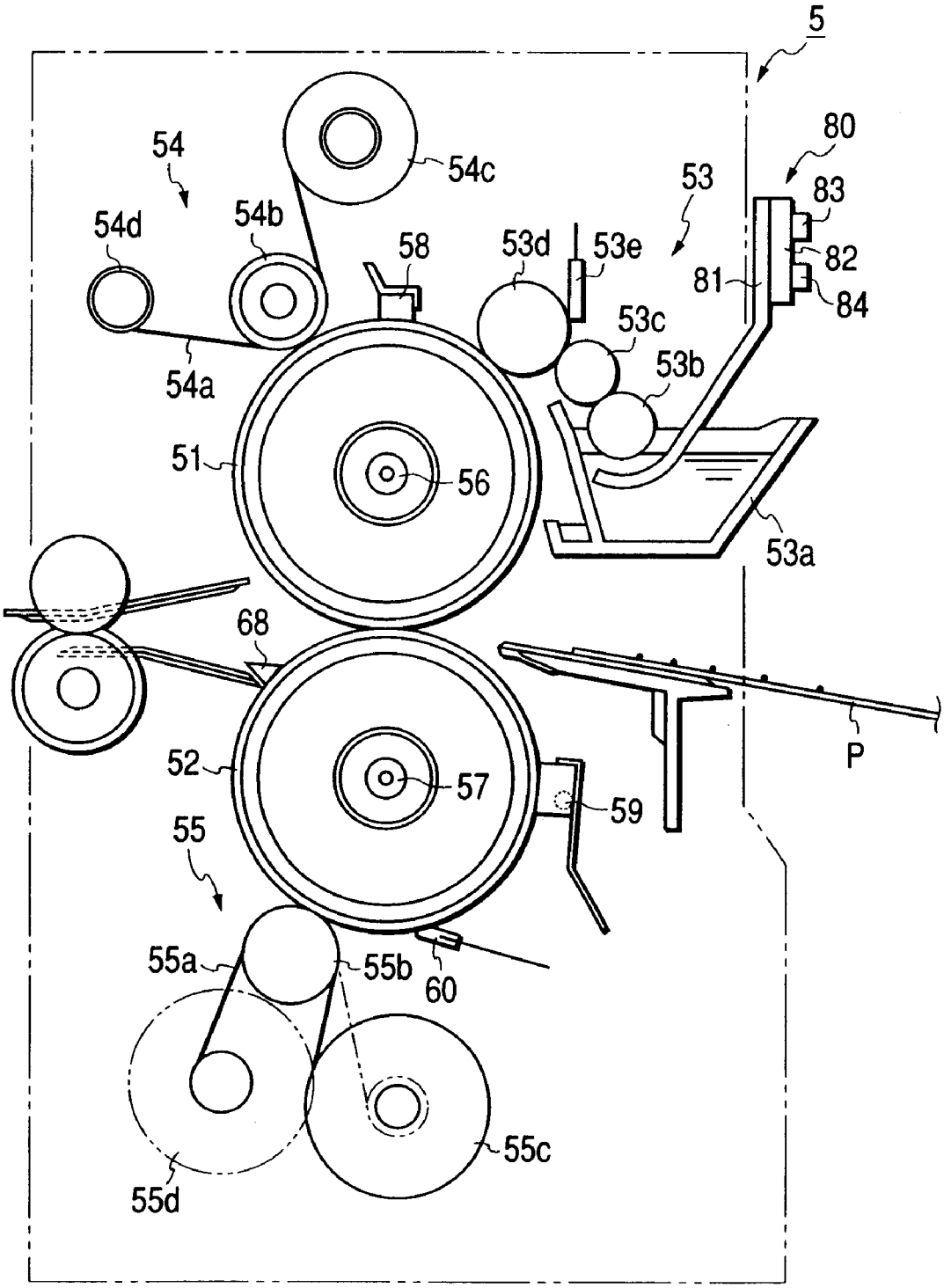
FIG. 1 is a view showing a fixing apparatus according to an embodiment of the present invention.

As shown in FIG. 1, the fixing apparatus 5 comprises a fixing roller 51 as a rotatable fixing rotary member, a pressure roller 52 as a pressurizing rotary member rotated while abutting against the fixing roller 51, a releasing agent coating device 53 as releasing agent coating means, and cleaning devices 54, 55. Incidentally, heaters 56, 57 such as halogen lamps are disposed within the fixing roller 51 as a fixing member and the pressure roller 52 as a fixing member, respectively. Further, thermistors 58, 59 are contacted with the fixing roller 51 and the pressure roller 52 so that surface temperatures of the fixing roller 51 and the pressure roller 52 are adjusted by controlling voltages to the heaters 56, 57 by means of a temperature adjusting circuit.

In the fixing roller 51 to which the cleaning device 54 and the releasing agent coating device 53 are attached, the toner offset onto the fixing roller 51 is cleaned by the cleaning device 54, and silicone oil as releasing agent is coated on the fixing roller 51 by the releasing agent coating device 53, thereby facilitating the separation of the recording paper P from the fixing roller 51 and preventing toner offset.

The cleaning device 54 comprises a cleaning web 54*a* formed from strip-shaped heat-resistive non-woven fabric, an urging roller 54*b* for urging the cleaning web 54*a* against the fixing roller 51, a supplying roller 54*c* for supplying a new cleaning web 54*a*, and a take-up roller 54*d* for gradually rewinding the cleaning web 54*a* a cleaning ability of which was reduced due to adhesion of toner. Particularly, in order to prevent false detection of the thermistor 58 due to adhesion of offset toner to the thermistor 58, the cleaning device 54 is disposed at an upstream side of the thermistor 58 in a rotational direction of the fixing roller 51.

By the way, as a method for rewinding the cleaning web 54*a*, there is a method in which, when it is judged that a predetermined number of copies are obtained by a counter, a solenoid (not shown) is turned ON to operate a one-way clutch thereby to rewind the cleaning web by a predetermined amount in a direction opposite to the rotational direction of the fixing roller 51. By rewinding the cleaning web 54*a* in the opposite direction in this way, the cleaning web 54*a* is prevented from being warped-in toward the rotational direction of the fixing roller 51.

Further, the releasing agent coating device 53 comprises a releasing agent containing portion 53*a* for containing the releasing agent such as silicone oil, pick-up rollers 53*b*, 53*c* for picking up the releasing agent from the releasing agent containing portion 53*a*, a coating roller 53*d* for coating the picked-up releasing agent to the fixing roller 51, and regulating blade 53*e* formed from an elastic material such as fluororubber and adapted to regulate an amount of the releasing agent on the coating roller to a given amount. Particularly in order to realize uniform oil coating on the fixing roller 51, the releasing agent coating device 53 is disposed at a downstream side of the thermistor 58 in a rotational direction of the fixing roller 51.

On the other hand, the pressure roller 52 is associated with the cleaning device 55 similar to the cleaning device 54 and comprising a cleaning web 55*a*, an urging roller 55*b*, a supplying roller 55*c*, and a take-up roller 55*d*, so -that the toner adhered to the pressure roller 52 is cleaned by the cleaning device 55 via the fixing roller 51.

Further, a releasing agent removing blade 60 as a releasing agent removing elastic body for removing excessive releasing agent remaining on the pressure roller 52 is urged against the pressure roller 52. Incidentally, if there is no releasing agent removing blade 60, the excessive releasing agent will be trapped and accumulated in a nip between the fixing roller 51 and the pressure roller 52, with the result that the recording paper P is contaminated or the OHP transparent laminated film is slipped, thereby causing poor penetration into the nip. As material of the releasing agent removing blade 60, Si rubber or fluororubber is used, and the releasing agent removing blade 60 abuts against the pressure roller 52 with an appropriate penetrating amount in a normal or reverse direction with respect to the rotational direction of the pressure roller 52.

When the recording paper P is conveyed, the fixing roller 51 and the pressure roller 52 are rotated, and the silicone oil as the releasing agent is coated on the surface of the fixing roller 51. While the recording paper P is being passed between the fixing roller 51 and the pressure roller 52, the recording paper is heated and pressurized with substantially constant pressure and temperature from both sides, with the result that the unfixed toner image is fixed to the recording paper, thereby forming a full-color image on the recording paper P. The recording paper P to which the image was fixed is separated from the pressure roller 52 by the lower separation claw 68 and then is discharged out of the apparatus.

The illustrated embodiment is characterized in that releasing agent heating means 80 for heating the releasing agent in the releasing agent containing portion 53*a* are provided as shown in FIG. 1.

Now, the releasing agent heating means 80 will be fully described with reference to FIGS. 2A and 2B.

Figure 2A:
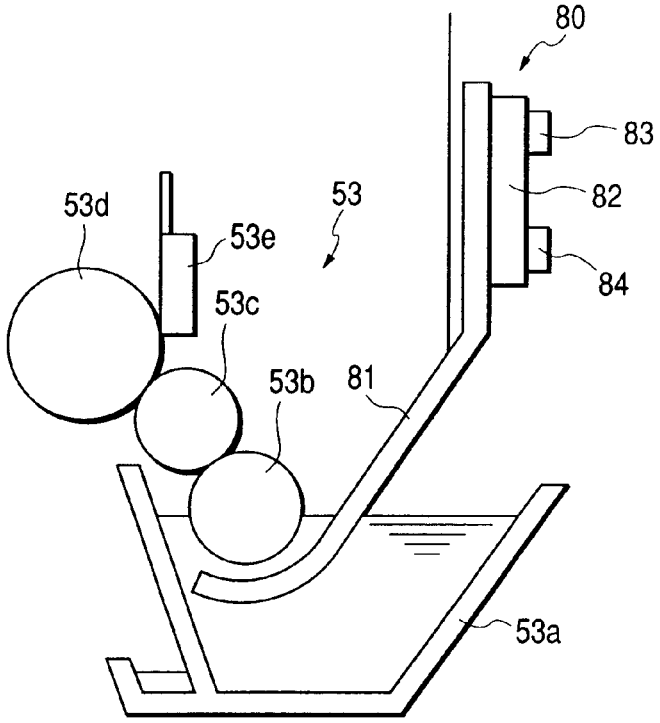
FIG. 2A is a view showing releasing agent heating means.

In FIG. 2A, a part of a metal plate 81 made of aluminum or copper as a heat conductive material having high heat conductivity is immersed into the oil as the releasing agent within the releasing agent containing portion 53*a*.

Figure 2B:
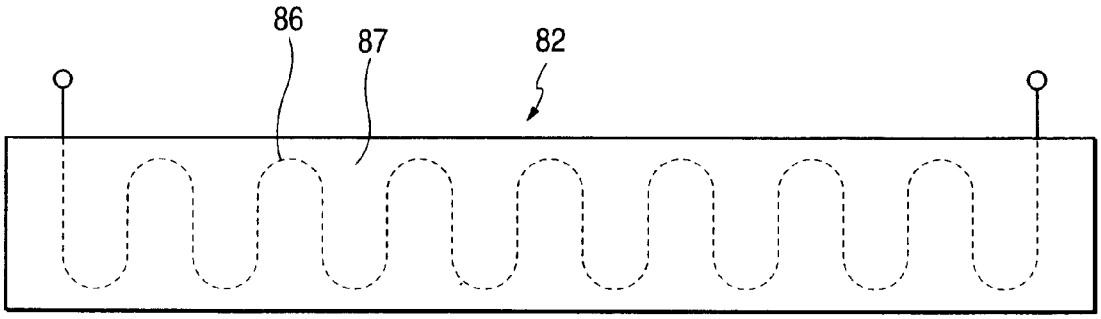
FIG. 2B is a view showing a heater.

In FIG. 2B, a heater 82 as heating means is a planar heat generating body obtained by covering a resistive heat generating body 86 capable of generating heat by energization with an insulation body 87 such as Si rubber and is contacted with the metal plate 81.

Further, a thermistor 83 as temperature detecting means serves to adjust the temperature of the heater 82 by abutting against the surface of the heater 82. A thermo-switch 84 for preventing excessive temperature increase is contacted with the surface of the heater 82.

Next, a state for heating the releasing agent in the releasing agent containing portion 53*a* by using the releasing agent heating means 80 having the above-mentioned construction will be explained.

When the heater 82 is energized, the resistive heat generating body generates heat, with the result that the temperature of the heater 82 starts to be increased toward a predetermined temperature. Incidentally, the surface temperature of the heater 82 is controlled by the thermistor 83.

Then, since the heated heater 82 is contacted with the metal plate 81, the heat of the heater 82 is transmitted to the metal plate 81. Since the metal plate 81 is made of metal such as aluminum or copper having high heat conductivity, the heat from the heater 82 is conducted within the metal plate 81. Since the part of the metal plate 81 is immersed into the releasing agent within the releasing agent containing portion 53*a*, the heat transferred through the metal plate 81 is transmitted to the releasing agent, thereby increasing the temperature of the releasing agent. Although the temperature of the releasing agent is increased as the temperature of the heater 82 is increased in this way, since the temperature increasing ratio of the heater 82 is greater than that of the releasing agent, when the temperature of the heater 82 reaches its temperature adjustment temperature, the heater is disenergized.

When the heater 82 is turned OFF as mentioned above, the temperature increase of the releasing agent becomes gentle. However, when the temperature of the heater 82 is decreased and the heater 82 is energized again, the temperature of the releasing agent is increased again. By repeating this cycle, the temperature of the releasing agent is gradually increased to reach a saturated temperature.

Incidentally, in order to hasten the heat conduction to the releasing agent, it is desirable that a thickness of the metal plate 81 is 3 mm or less. Further, in order to improve the heat conduction between the heater 82 and the metal plate 81, it is preferable that the heater 82 be closely contacted with the metal plate 81. More preferably, the heater 82 is integrally formed with the metal plate 81.

Figure 3:
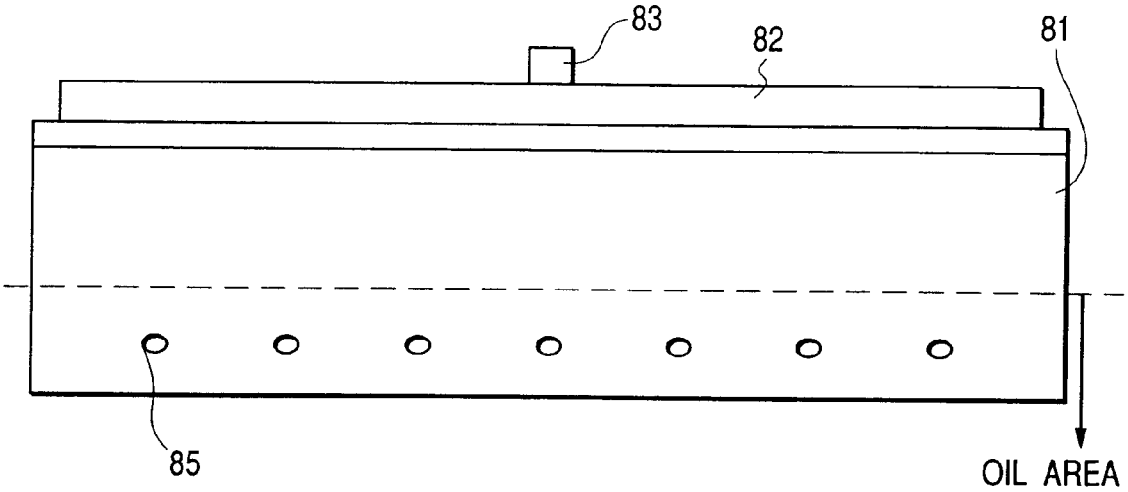
FIG. 3 is a front view of the releasing agent heating means.

Further, in order to improve circulation of the releasing agent, it is preferable that the portion of the metal plate 81 immersed into the releasing agent has holes 85, as shown in FIG. 3.

Further, as shown in FIG. 2A, when the portion of the metal plate 81 immersed into the releasing agent is closely adjacent to a pick-up roller 53*b*, the high temperature releasing agent can be supplied to the releasing agent coating device 53 efficiently.

Further, since the heater 82 is not immersed into the releasing agent and the temperature of the heater is controlled by the thermistor 83 and the excessive temperature increase is prevented by the thermo-switch 84, the safety is ensured. Since the transmission of the heat of the heater 82 to the metal plate 81 is facilitated by using the metal plate 81 having high heat conductivity, the temperature increase of the releasing agent is hastened, thereby improving the fixing ability.

In this way, in the illustrated embodiment, since the heater is disposed outside of the containing portion and the metal plate contacted with the heater is disposed within the containing portion to contact with the releasing agent, electrical safety is ensured and the releasing agent can be heated quickly and adequately.

Figure 4:
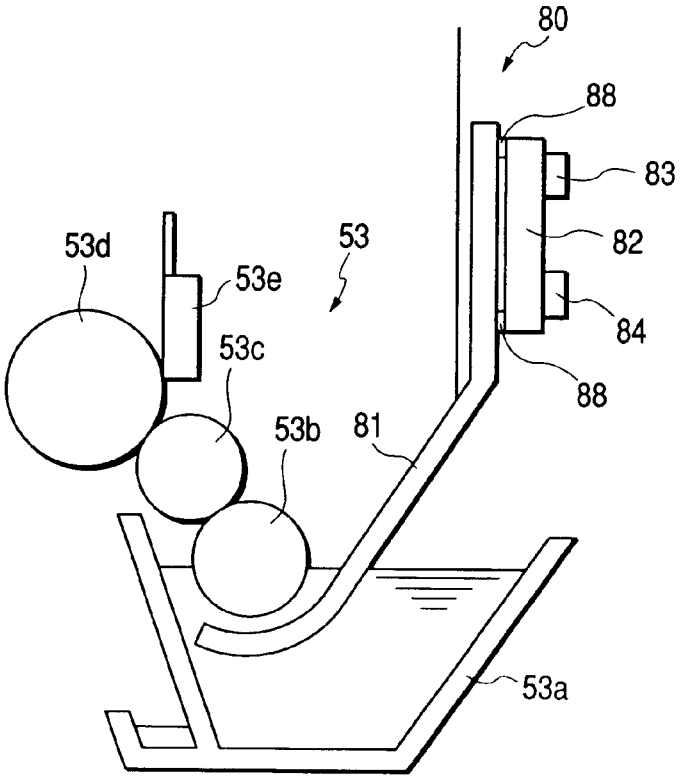
FIG. 4 is a view showing the releasing agent heating means.

Incidentally, when the electrical leak from the heater is further prevented, as shown in FIG. 4, an electrically insulative spacer 88 is provided between the heater and the metal plate so that the metal plate is located in the vicinity of the heater without contact therebetween.

Figure 5:
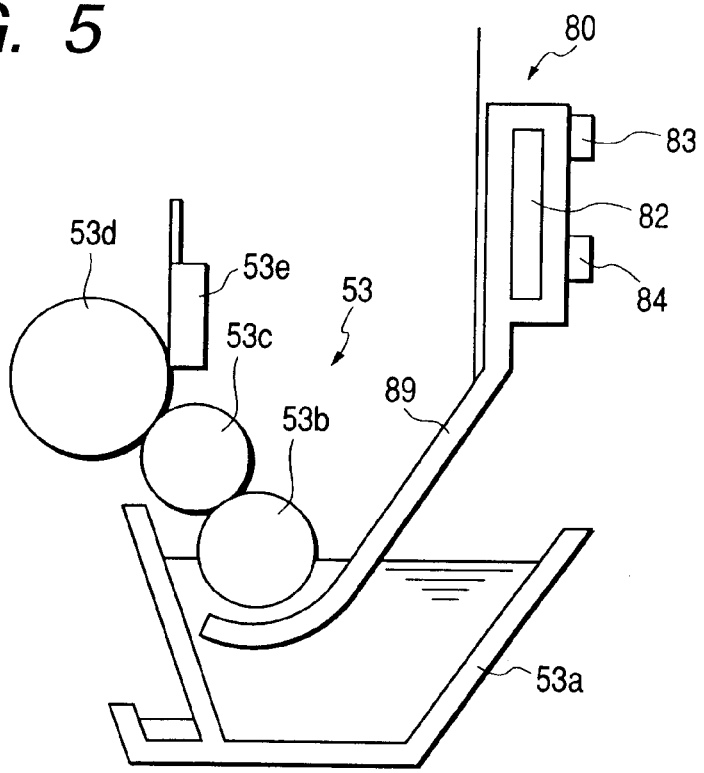
FIG. 5 is a view showing the releasing agent heating means.

Next, another embodiment of the present invention will be explained with reference to FIG. 5. Incidentally, FIG. 5 is a sectional view showing releasing agent heating means of a fixing apparatus according to this embodiment. In FIG. 5, the same elements as those shown in FIG. 2 are designated by the same reference numerals and explanation thereof will be omitted.

As shown in FIG. 5, this embodiment is characterized in that the heater 82 is covered by a metal plate 89. Namely, the metal plate encloses the heater and is integrally formed with the heater.

According to this embodiment, since the contact area between the heater 82 and the metal plate 89 is increased, much heat is transferred from the heater 82 to the metal plate 89, thereby heating the releasing agent more efficiently.

Figure 6:
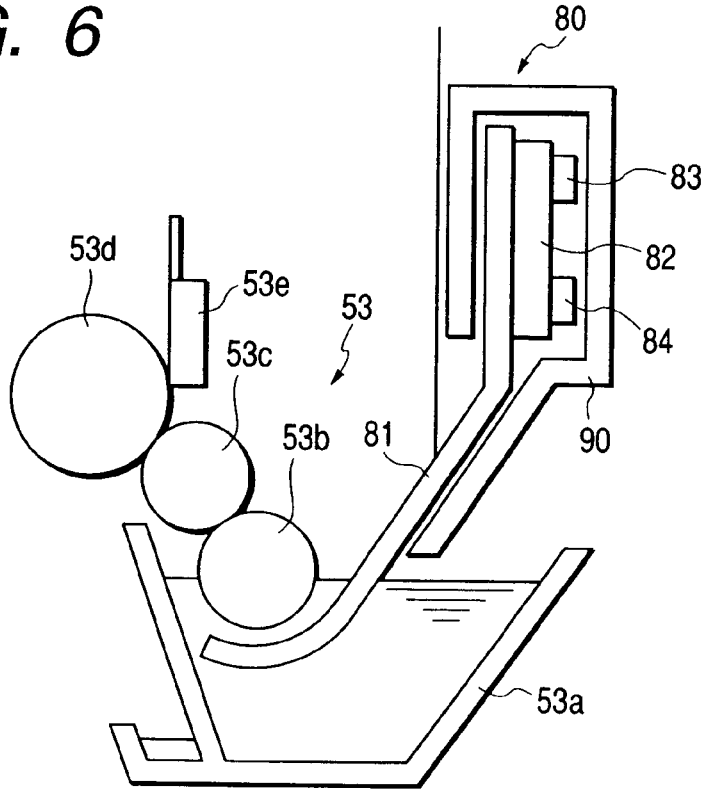
FIG. 6 is a view showing the releasing agent heating means.

Next, a further embodiment of the present invention will be explained with reference to FIG. 6. Incidentally, FIG. 6 is a sectional view showing releasing agent heating means of a fixing apparatus according to this embodiment. Also in FIG. 6, the same elements as those shown in FIG. 2 are designated by the same reference numerals and explanation thereof will be omitted.

As shown in FIG. 6, this embodiment is characterized in that the heater 82 and the metal plate 81 are covered by a heat isolation member 90.

According to this embodiment, since heat radiation from the heater 82 and the metal plate 81 can be suppressed, the releasing agent can be heated more efficiently.

While specific embodiments were explained, the present invention is not limited to such embodiments, and various alterations can be made within the scope of the invention.

What is claimed is:

1. A fixing apparatus comprising:

a fixing member for fixing an unfixed image to a recording material;

releasing agent coating means for coating releasing agent on said fixing member, said releasing agent coating means having a containing portion for containing the releasing agent; and releasing agent heating means for heating the releasing agent;

wherein said releasing agent heating means have a heating body, and a heat conductive member contacted with said heating body or disposed near said heating body, and said heating body is disposed outside of said containing portion, and said heat conductive member is disposed within said containing portion to be contacted with the releasing agent.

2. A fixing apparatus according to claim 1, wherein said heating body has a heat generating body for generating heat by energization.

3. A fixing apparatus according to claim 1, wherein said releasing agent coating means have a pick-up member for picking up the releasing agent from said containing portion, and said heat conductive member is disposed near said pick-up member.

4. A fixing apparatus according to claim 1, wherein said heat conductive member is made of metal.

5. A fixing apparatus according to claim 4, wherein the metal is aluminium or copper.

6. A fixing apparatus according to claim 1, wherein said heat conductive member has a plate shape.

7. A fixing apparatus according to claim 1, wherein said heat conductive member encloses said heating body and is integrally formed with said heating body.

8. A fixing apparatus according to claim 1, further comprising a heat isolation member for covering said heating body and said heat conductive member.

9. A fixing apparatus according to claim 1, wherein said heat conductive member has a hole.

10. A fixing apparatus according to claim 1, wherein said releasing agent coating means include a pick-up member for picking up the releasing agent from said containing portion, and a coating member for coating the releasing agent picked up by said pick-up member on said fixing member.

11. A fixing apparatus according to claim 1, further comprising a pressurizing member for forming a nip with said fixing member, and the recording material bearing an unfixed image is pinched and conveyed by the nip so that the unfixed image is fixed to the recording material.

* * * * *

UNITED STATES PATENT AND TRADEMARK OFFICE

CERTIFICATE OF CORRECTION

PATENT NO. : 6,272,307 B1
DATED : August 7, 2001
INVENTOR(S) : Jiro Ishizuka et al.

It is certified that error appears in the above-identified patent and that said Letters Patent is hereby corrected as shown below:

Title page,
Item [75], Inventor, "Shozo Shimada, Nobeoka," should read -- Shozo Shimada, Miiyazaki-ken, --.

Column 3,
Line 7, "-the" should read -- the --.

Column 7,
Line 12, "have" should read -- has --.

Column 8,
Line 10, "include" should read -- includes --.

Signed and Sealed this

Sixteenth Day of April, 2002

*Attest:*

*Attesting Officer*

JAMES E. ROGAN
*Director of the United States Patent and Trademark Office*